US012599250B2

(12) United States Patent
Belajac

(10) Patent No.: US 12,599,250 B2
(45) Date of Patent: Apr. 14, 2026

(54) MULTIPLE POSITION INFANT SUPPORT SYSTEM

(71) Applicant: Maura Belajac, Sewickley, PA (US)

(72) Inventor: Maura Belajac, Sewickley, PA (US)

( * ) Notice: Subject to any disclaimer, the term of this patent is extended or adjusted under 35 U.S.C. 154(b) by 44 days.

(21) Appl. No.: 18/652,498

(22) Filed: May 1, 2024

(65) Prior Publication Data

US 2025/0338975 A1 Nov. 6, 2025

(51) Int. Cl.
*A47D 15/00* (2006.01)

(52) U.S. Cl.
CPC ..... *A47D 15/008* (2013.01)

(58) Field of Classification Search
None
See application file for complete search history.

(56) References Cited

U.S. PATENT DOCUMENTS 5,392,785 A * 2/1995 Donahue ..... A47D 15/003 5/655
5,546,620 A * 8/1996 Matthews ..... A47D 13/08 5/639
5,930,854 A * 8/1999 O'Neill ..... A47D 13/063 135/96
8,914,927 B1 * 12/2014 Leach ..... A47D 11/007 5/640
2018/0338628 A1 * 11/2018 Goodwin ..... A47D 15/008
2025/0221553 A1 * 7/2025 Perper ..... A47G 9/109

* cited by examiner

*Primary Examiner* — Adam C Ortiz

(57) ABSTRACT

A multiple position infant support system includes a base pad having an upper surface and a peripheral edge extending around the upper surface. A fixed cushion is coupled to said base pad and a pivot cushion is couplable to the fixed cushion. The fixed cushion and the pivot cushion are each U-shaped and positionable such that the pivot cushion and the fixed cushion extend around the upper surface of the base pad. The pivot cushion is alternatively positionable atop the fixed cushion.

18 Claims, 7 Drawing Sheets

MULTIPLE POSITION INFANT SUPPORT SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to infant support devices and more particularly pertains to a new infant support device for adjusting into multiple positions for enhanced functionality in a single system.

(2) Description of Related Art Including Information Disclosed Under 37 CFR 1.97 and 1.98

The prior art relates to infant support devices. Known infant supports address supporting an infant in a limited number of positions which may include some but not all of stomach time propping, infant bed, sitting up support, and play gym.

BRIEF SUMMARY OF THE INVENTION

An embodiment of the disclosure meets the needs presented above by generally comprising a base pad having an upper surface and a peripheral edge extending around the upper surface. A fixed cushion is coupled to said base pad and a pivot cushion is couplable to the fixed cushion. The fixed cushion and the pivot cushion are each U-shaped and positionable such that the pivot cushion and the fixed cushion extend around the upper surface of the base pad. The pivot cushion is alternatively positionable atop the fixed cushion.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
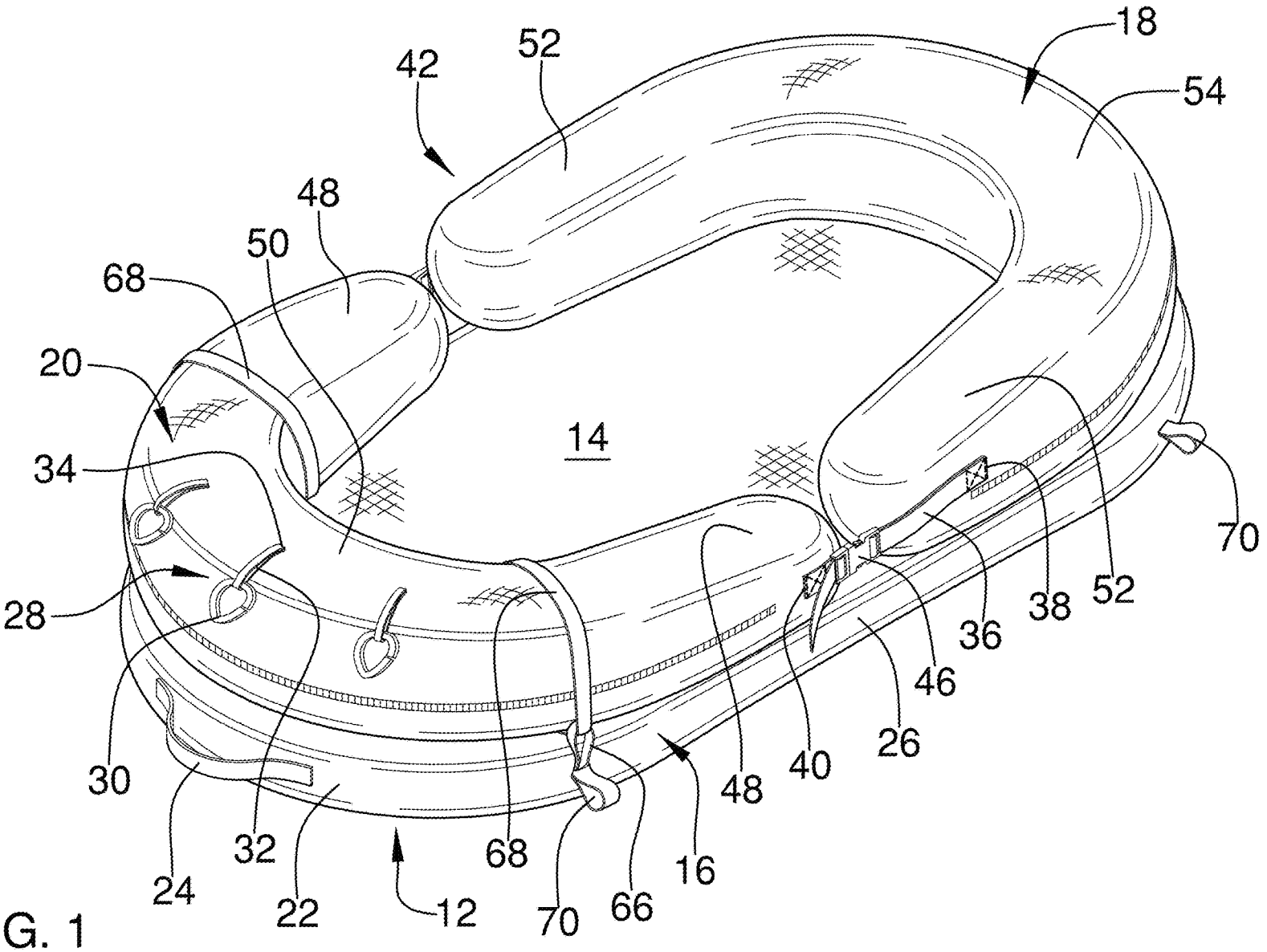
FIG. 1 is a top front side perspective view of a multiple position infant support system according to an embodiment of the disclosure.

With reference now to the drawings, and in particular to FIGS. 1 through 7 thereof, a new infant support device embodying the principles and concepts of an embodiment of the disclosure and generally designated by the reference numeral 10 will be described.

As best illustrated in FIGS. 1 through 7, the multiple position infant support system 10 generally comprises a base pad 12 having an upper surface 14 and a peripheral edge 16 extending around the upper surface 14 of the base pad 12. The peripheral edge 16 of the base pad 12 has curved ends 22 such that the base pad 12 is obround shaped. The base pad 12 may be constructed of foam or the like. A fixed cushion 18 is coupled to the base pad 12. The fixed cushion 18 may be attached by stitching, an adhesive, or other semi-permanent fastener. Alternatively, the fixed cushion may be removably coupled to the upper surface 14 of the base pad 12 using hook and loop fastener, snaps, buttons, or the like such that the fixed cushion 18 is removable but held in a static position relative to the base pad 12 when attached to the base pad 18. A pivot cushion 20 is couplable to the fixed cushion 18. The fixed cushion 18 and the pivot cushion 20 are each U-shaped and positionable such that the pivot cushion 20 and the fixed cushion 18 extend around the upper surface 14 of the base pad 12. Alternatively, the pivot cushion 20 is positionable atop the fixed cushion 18 as described more fully below.

Each of a pair of handles 24 is positioned on a respective one of the curved ends 22 of the peripheral edge 16. There may be a single handle 24 or additional handles 24 at alternative positions on the base pad 12 including along longitudinal sides 26 of the peripheral edge 16 of the base pad 12.

Each a plurality of toy clips 28 is coupled to the pivot cushion 20. The toy clips 28 may be a teardrop shaped ring 30 attached to the pivot cushion 20 by a toy attachment loop 32 having a fixed end 34 positioned to allow the ring 30 to extend outwardly over the pivot cushion 20 and towards the peripheral edge 16 such that a toy clipped to the toy clip 28 can hang on an outer side of the pivot cushion 20. The teardrop shape of the ring 30 facilitates centering of the toy attached to the toy clip 28 relative to the toy clip 28 to generally maintain spacing of toys attached to adjacent toy clips 28. Further, the toy clips 28 may be positioned and arranged to extend radially on the pivot cushion 20.

Figure 2:
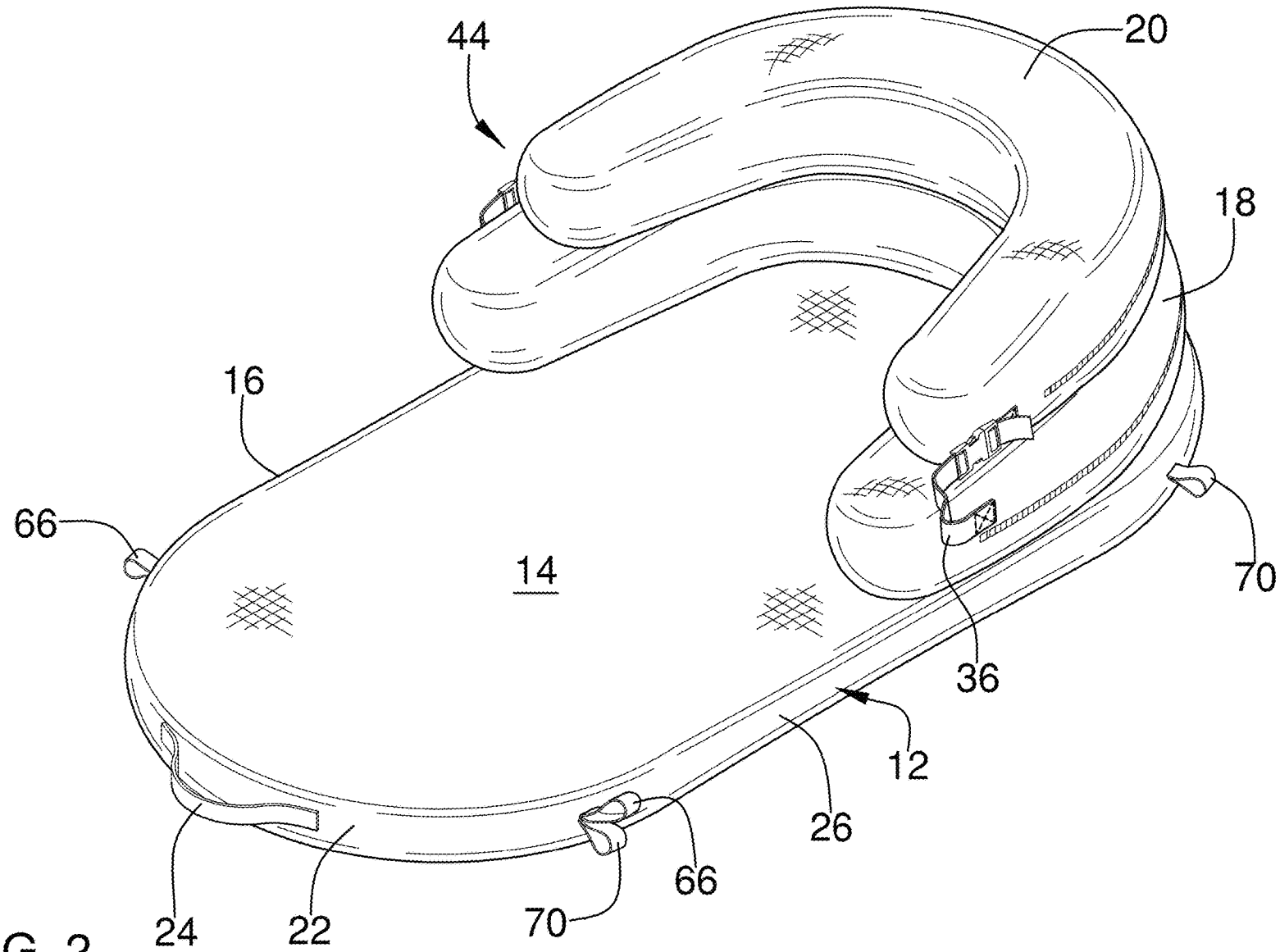
FIG. 2 is a top front side perspective view of an embodiment of the disclosure in an alternate position.

Each of a pair of bands 36 has a first end 38 coupled to the fixed cushion 18 and a second end 40 coupled to the pivot cushion 20 wherein the pair of bands 36 couples the pivot cushion 20 to the fixed cushion 18 allowing the pivot cushion 20 to be pivoted between a first configuration 42, as shown in FIG. 1, in which both the fixed cushion 18 and the pivot cushion 20 are positioned on the upper surface 14 of the base pad 12, and a second configuration 44, as shown in FIG. 2, in which the pivot cushion 20 is stacked onto the fixed cushion 18. Each of the bands 36 has a respective break between the first end 38 and the second end 40. Each of a pair of connectors 46 is coupled to a respective one of the bands 36 wherein the pivot cushion 20 is releasably coupled to the fixed cushion 20 by one of the pair of bands 36. The connector 46 may be a conventional type of buckle including side release buckles. Further, a respective length of each of the bands 36 may be adjustable.

The pivot cushion 20 has a pair of pivot cushion arms 48 extending from a middle section 50 of the pivot cushion 20. Similarly, the fixed cushion 18 has a pair of fixed cushion arms 52 extending from a central section 54 of the fixed cushion 20. A bottom surface 56 of the pivot cushion 20 is planar and a top surface 58 of the pivot cushion 20 is planar and angled relative to the bottom surface 56. Thus, a height of the pivot cushion 20 between the bottom surface 58 and the top surface 56 of the pivot cushion 20 tapers extending along the pair of pivot cushion arms 48 away from the middle section 50 of the pivot cushion 20. Similarly, a base surface 60 of the fixed cushion 18 is planar and a top surface 62 of the fixed cushion 18 is planar and angled relative to the base surface 60 such that a height of the fixed cushion 18 between the base surface 60 and the top surface 62 of the fixed cushion 18 tapers extending along the pair of fixed cushion arms 52 away from the central section 54 of the fixed cushion 18.

Each of a pair of securing loops 66 is coupled to the base pad 12 and each of a pair of securing straps 68 is couplable to a respective one of the securing loops 66. Each securing strap 68 is positionable to extend around a respective one of the pair of pivot cushion arms 48 to secure the pivot cushion 20 to the base pad 12 while in the first configuration 42. The pivot cushion 20 and the fixed cushion 18 are positioned to encircle a medial portion of the upper surface 14 of the base pad 12 when the pivot cushion is secured to the base pad 12 by the securing straps. 68. Accessory loops 70 are coupled to the base pad 12. Each of the accessory loops 70 extends outwardly from the peripheral edge 16 of the base pad 12. The accessory loops 70 may be distributed around the peripheral edge 16 including particularly proximate to corners of the base pad 12 located at opposed junctions of the curved ends 22 with longitudinal sides of the base pad 12. Each of a pair of support poles 72 is resiliently flexible and a connector 74 couplable to the pair of support poles 72. The connector 74 is positionable adjacent to respective centers of each support pole 72 allowing the support poles 72 to be positioned to form an X-shape. Each of the support poles 72 is couplable to opposed pairs of the accessory loops 70 diagonally across the base pad 12 wherein the support poles 72 are held in a rounded formation extending over the base pad 12. Each of a plurality of objects 76 is coupled to the pair of support poles 72 wherein the pair of support poles 72 suspends the plurality of objects 76 over the base pad 12 allowing an infant 78 to see and reach for the objects 76 while lying on the base pad 12. Each of the securing loops 66 may be positioned adjacent to an associated one of the accessory loops 70.

The pivot cushion 20 may have a pivot cushion core 80 enveloped by a pivot cushion liner 82. A pivot cushion closure 84 is coupled to the pivot cushion liner 82. The pivot cushion closure 84 may be a zipper or the like selectively closing a pivot cushion opening 86 wherein the pivot cushion core 80 is selectively removable from the pivot cushion liner 82. Similarly, the fixed cushion 18 may have a fixed cushion core 88 enveloped by a fixed cushion liner 90. A fixed cushion closure 92, which may also be a zipper of the like, is coupled to the fixed cushion liner 90 selectively closing a fixed cushion opening 94 wherein the fixed cushion core 88 is selectively removable from the fixed cushion liner 90.

Figure 3:
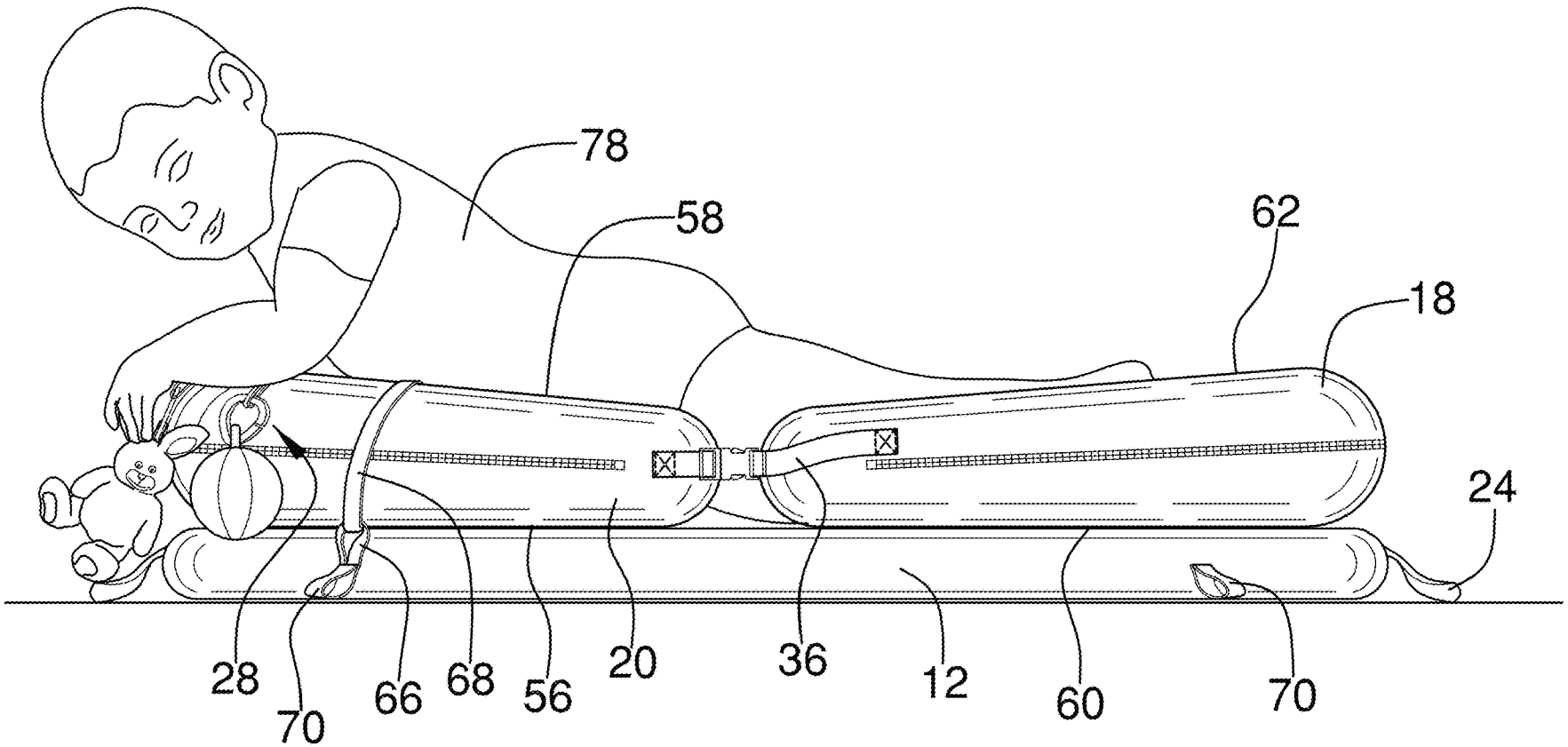
FIG. 3 is a side view of an embodiment of the disclosure in use.
Figure 4:
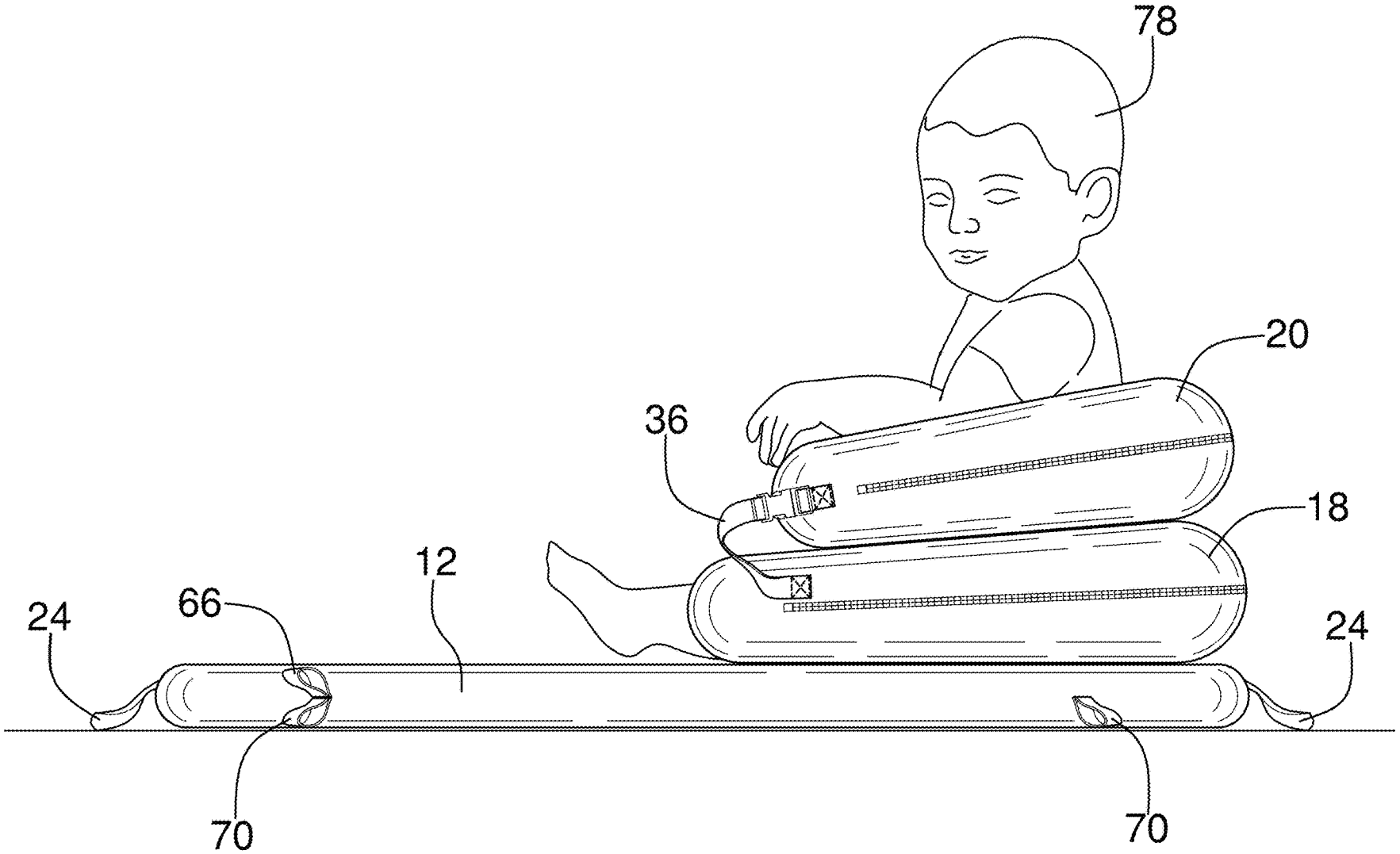
FIG. 4 is a side view of an embodiment of the disclosure in use in the alternate position.
Figure 5:
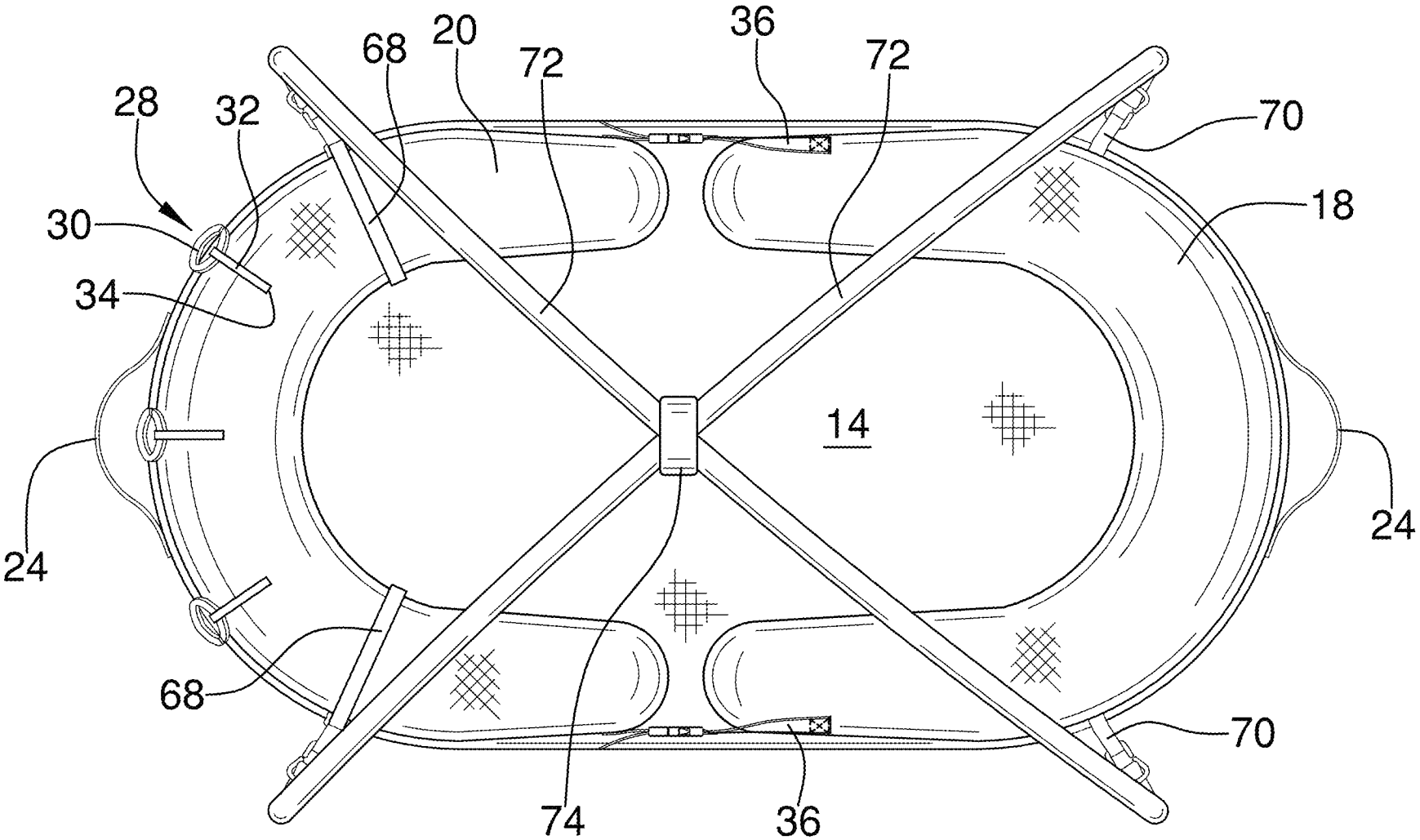
FIG. 5 is a top view of an embodiment of the disclosure.
Figure 6:
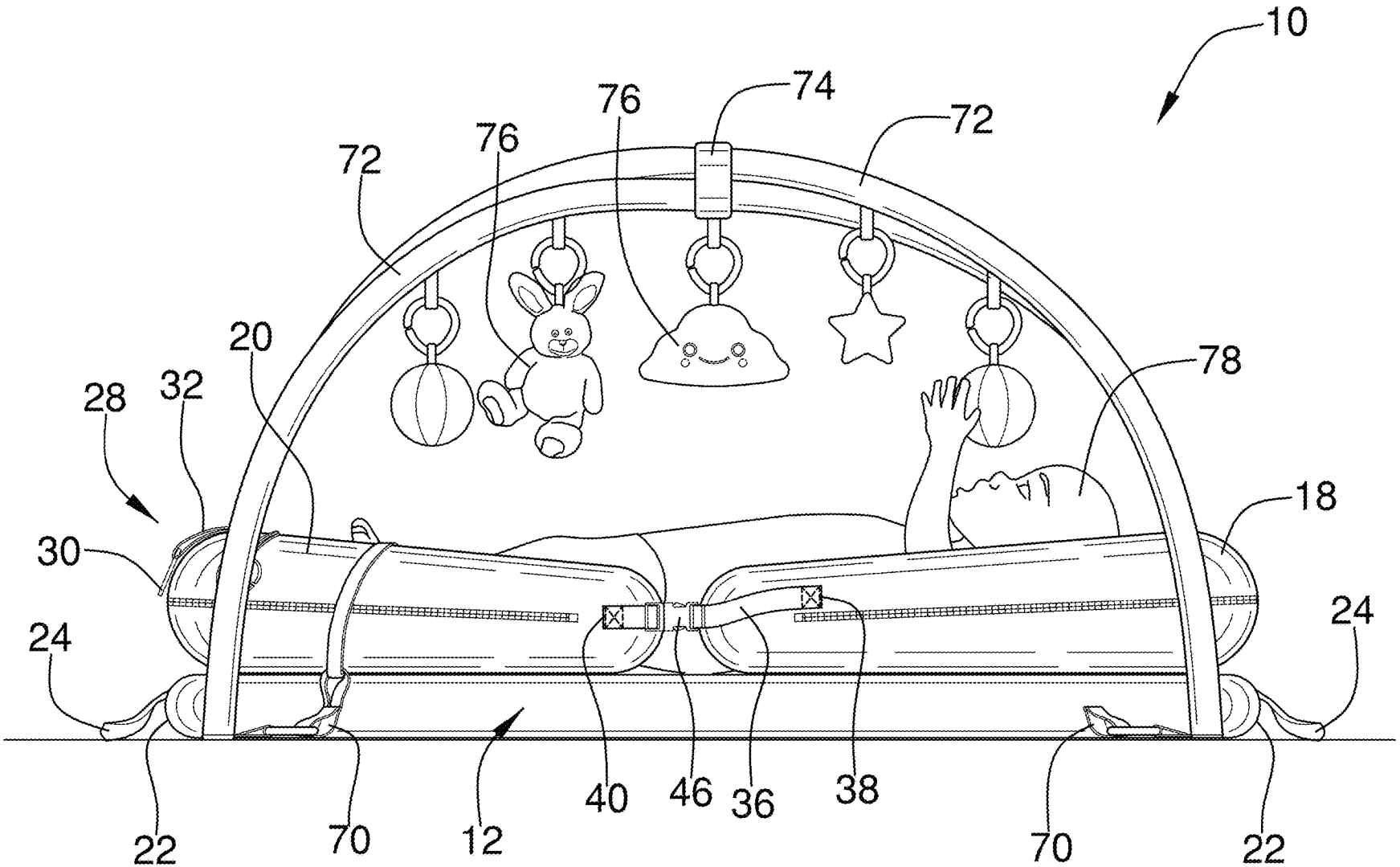
FIG. 6 is a side view of an embodiment of the disclosure in use.
Figure 7:
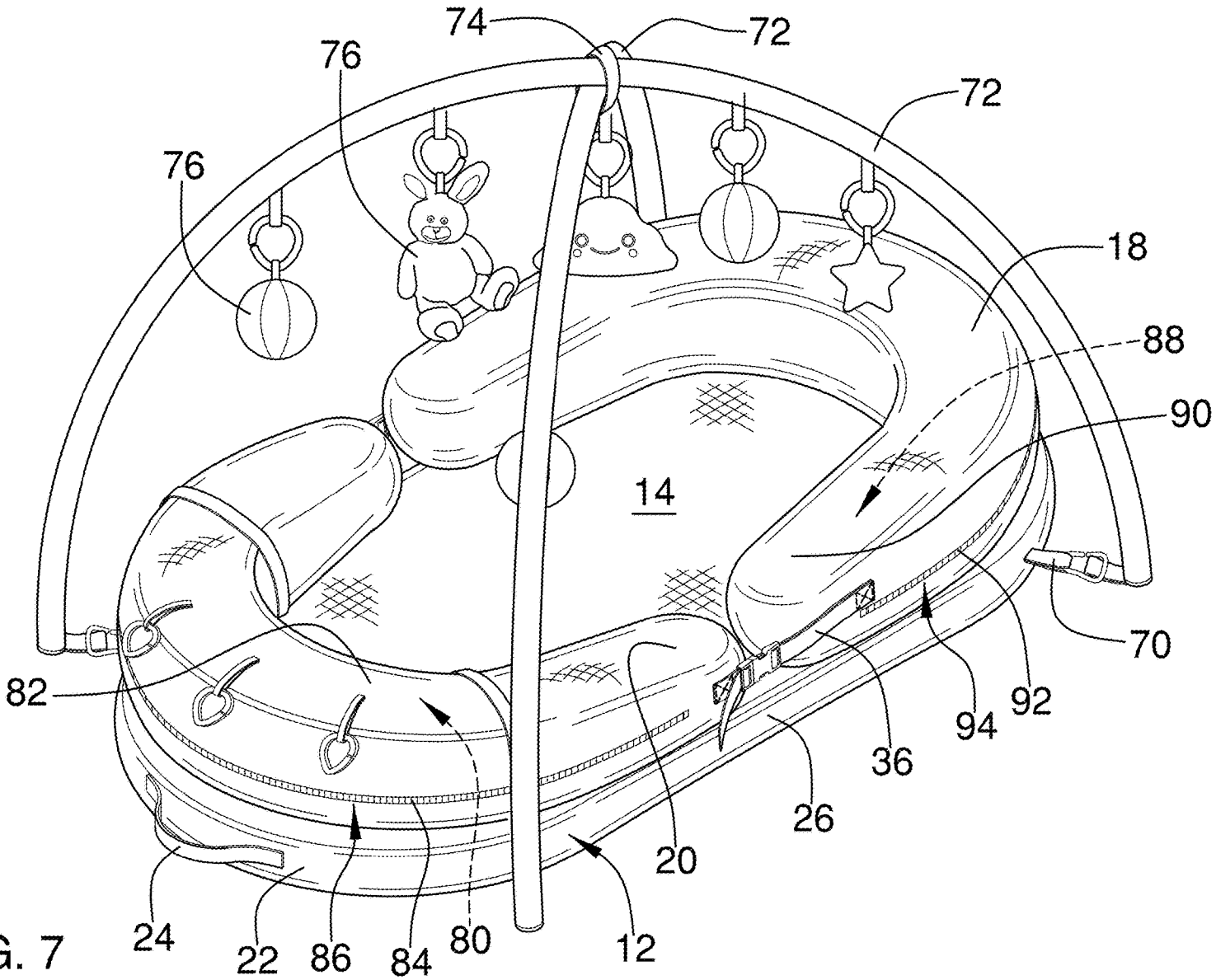
FIG. 7 is a top front side perspective view of an embodiment of the disclosure.

In use, the first configuration 42 allows for placing the infant 78 in a prone position propped onto the pivot cushion 20, as shown in FIG. 3, where the infant 78 may access toys clipped to the toy clips 28. The infant 78 may alternatively be placed on their back on the upper surface 14 of the base pad 12 with the support poles 72 attached creating a play gym for the infant 78. In the second configuration 44, the infant 78 may be positioned in a position sitting up such that the pivot cushion 20 and fixed cushion provide back and lateral support to the infant 78, as shown in FIG. 4.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A multiple position infant support system comprising:

a base pad having an upper surface and a peripheral edge extending around said upper surface;

a fixed cushion coupled to said base pad;

a pivot cushion couplable to said fixed cushion, said fixed cushion and said pivot cushion each being U-shaped and being positionable such that said pivot cushion and said fixed cushion extend around said upper surface of said base pad, said pivot cushion being positionable atop said fixed cushion;

said pivot cushion having a pair of pivot cushion arms extending from a middle section of said pivot cushion;

said fixed cushion having a pair of fixed cushion arms extending from a central section of said fixed cushion;

a pair of securing loops coupled to said base pad; and a pair of securing straps, each securing strap being coupable to a respective one of said securing loops, each securing strap being positionable to extend around a respective one of said pair of pivot cushion arms wherein said pair of securing straps secure said pivot cushion to said base pad.

2. The multiple position infant support system of claim 1, further comprising accessory loops coupled to said base pad, each of said accessory loops extending outwardly from a periphery of said base pad.

3. The multiple position infant support system of claim 2, further comprising:

a pair of support poles, each of said support poles being resiliently flexible;

a connector couplable to said pair of support poles, said connector being positionable adjacent to respective centers of each support pole wherein said support poles are positionable to form an X-shape; and wherein each of said support poles is couplable to opposed pairs of said accessory loops diagonally across said base pad wherein said support poles are held in a rounded formation extending over said base pad.

4. The multiple position infant support system of claim 3, further comprising a plurality of objects being coupled to said pair of support poles wherein said pair of support poles suspends said plurality of objects over said base pad.

5. The multiple position infant support system of claim 1, wherein said peripheral edge of said base pad has curved ends such that said base pad is obround shaped.

6. The multiple position infant support system of claim 5, further comprising a pair of handles, each handle being positioned on a respective one of said curved ends of said peripheral edge.

7. The multiple position infant support system of claim 1, further comprising a plurality of toy clips being coupled to said pivot cushion.

8. The multiple position infant support system of claim 1, further comprising a pair of bands, each band having a first end coupled to said fixed cushion and a second end coupled to said pivot cushion wherein said pair of bands couples said pivot cushion to said fixed cushion.

9. The multiple position infant support system of claim 8, further comprising:

each of said bands having a respective break between said first end and said second end; and a pair of connectors, each connector being coupled to a respective one of said bands wherein said pivot cushion is releasably coupled to said fixed cushion by said pair of bands.

10. The multiple position infant support system of claim 1, further comprising:

a bottom surface of said pivot cushion being planar; and a top surface of said pivot cushion being planar and angled relative to said bottom surface wherein a height of said pivot cushion between said bottom surface and said top surface of said pivot cushion tapers extending along said pair of pivot cushion arms away from said middle section of said pivot cushion.

11. The multiple position infant support system of claim 1, further comprising:

a base surface of said fixed cushion being planar; and a top surface of said fixed cushion being planar and angled relative to said base surface wherein a height of said fixed cushion between said base surface and said top surface of said fixed cushion tapers extending along said pair of fixed cushion arms away from said central section of said fixed cushion.

12. The multiple position infant support system of claim 1, further comprising:

accessory loops coupled to said base pad, each of said accessory loops extending outwardly from a periphery of said base pad wherein each of said accessory loops; and each of said securing loops being positioned adjacent to an associated one of said accessory loops.

13. The multiple position infant support system of claim 1, further comprising said pivot cushion and said fixed cushion being positioned to encircle a medial portion of said upper surface of said base pad when said pivot cushion is secured to said base pad by said securing straps.

14. The multiple position infant support system of claim 8, further comprising a respective length of each of said bands being adjustable.

15. The multiple position infant support system of claim 1, further comprising said pivot cushion having a pivot cushion core enveloped by a pivot cushion liner.

16. The multiple position infant support system of claim 15, further comprising a pivot cushion closure being coupled to said pivot cushion liner, said pivot cushion closure selectively closing a pivot cushion opening wherein said pivot cushion core selectively removable from said pivot cushion liner.

17. The multiple position infant support system of claim 1, further comprising said fixed cushion having a fixed cushion core enveloped by a fixed cushion liner.

18. The multiple position infant support system of claim 17, further comprising a fixed cushion closure being coupled to said fixed cushion liner, said fixed cushion closure selectively closing a fixed cushion opening wherein said fixed cushion core is selectively removable from said fixed cushion liner.

* * * * *